United States Patent [19]

Doty

[11] Patent Number: 4,776,777

[45] Date of Patent: Oct. 11, 1988

[54] ROLLING CYLINDER ENGINE SYSTEM

[76] Inventor: George D. Doty, 1550 University Heights, Boulder, Colo. 80302

[21] Appl. No.: 137,959

[22] Filed: Dec. 23, 1987

Related U.S. Application Data

[63] Continuation-in-part of Ser. No. 29,711, Mar. 24, 1987.

[51] Int. Cl.[4] ..... F01C 1/02

[52] U.S. Cl. ..... 418/61.1

[58] Field of Search ..... 418/61 R

[56] References Cited

U.S. PATENT DOCUMENTS 910,175 1/1909 Cole ..... 418/61 R 4,005,951 2/1977 Swinkels ..... 418/61 R

*Primary Examiner*—Allen M. Ostrager

*Attorney, Agent, or Firm*—Donald W. Margolis; John L. Isaac

[57] ABSTRACT

An engine for rotating an output shaft includes a housing which defines an inner cylindrical surface coaxial with the output shaft. A roller member is disposed within the housing and includes an inner cylindrical bearing surface and an outer cylindrical surface spaced from the inner surface of the housing. Longitudinal axis of the rolling member is radially offset from the axis of the housing and the shaft. A mechanism is provided for preventing relative rotation and movement between the housing and the rolling member, and a plurality of chambers are defined between the housing and the rolling member. Devices are provided for selectively introducing expansive gas or fluid into the chamber in rotationally sequential fashion, and devices are further provided for exhausting expanding gas or fluid from the chambers in rotationally sequential fashion to urge the roller member away from the housing and expand the chambers at the site of the expansive gas or fluid introduction. This rolls the roller member about the inner cylindrical surface of the housing with the axis of the roller member rolling about the central axis of the housing and shaft. Finally, a mechanism is provided for rotating the shaft in response to the rolling movement of the roller member within the housing.

34 Claims, 12 Drawing Sheets

4
4
18
100
46
98
100
44
130
102
98
133
131
132
134
136
135
137
70
60
10
12
14
16
22
24
32
34
48
50
52
54
56
58
60
70
72A
72B
72C
72D
74A
74B
74C
74D
76
78
80
82
84
86
88
90
92
94
96
98
102
104
116
138

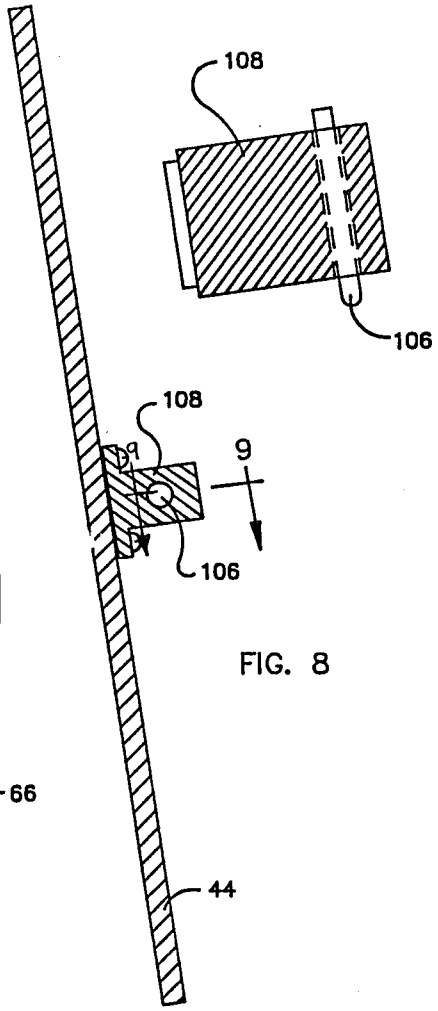
FIG. 9
FIG. 8
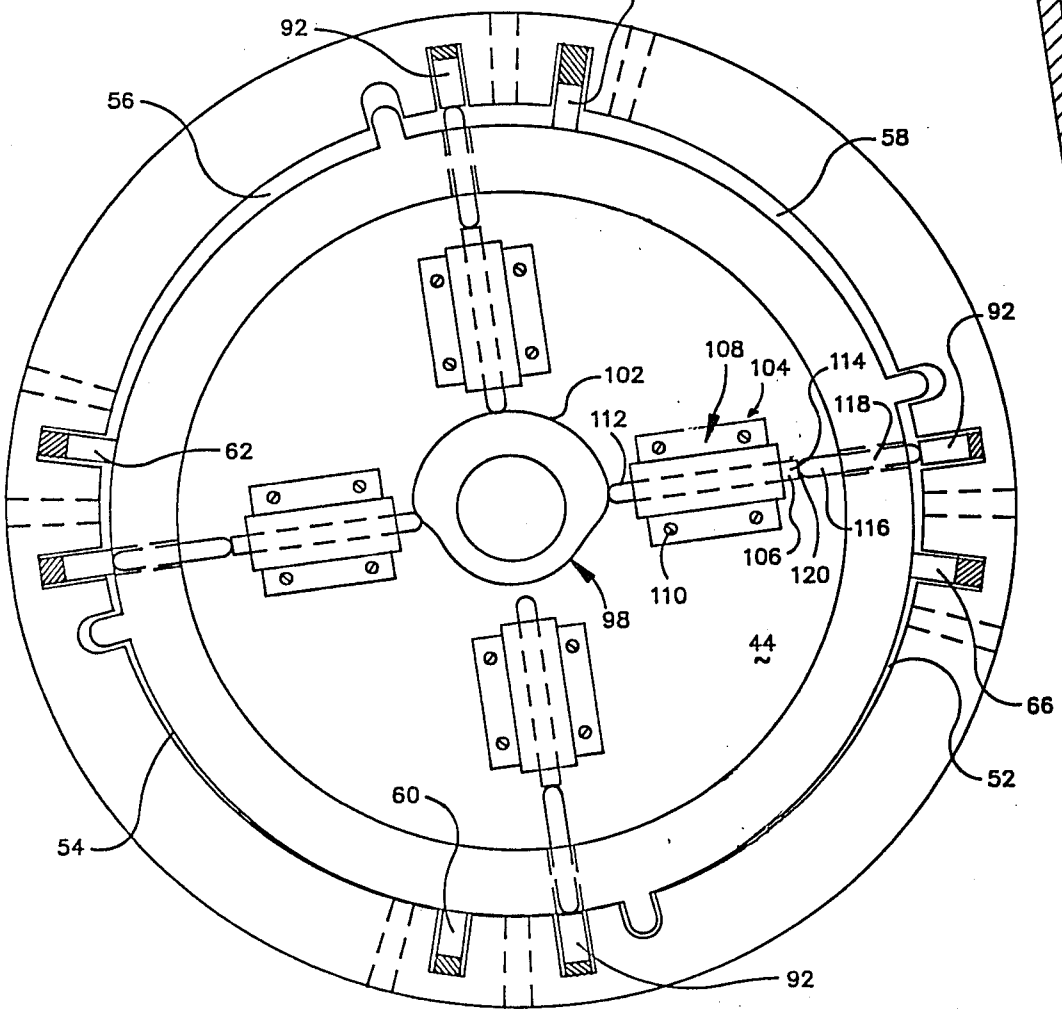
FIG. 7

ROLLING CYLINDER ENGINE SYSTEM

RELATED APPLICATIONS

This application is a continuation-in-part of U.S. Patent application Ser. No. 07/029,711, filed Mar. 24, 1987.

BACKGROUND OF THE INVENTION

1. Field of the Invention

This invention relates to engines for converting fluid energy to mechanical energy, and more particularly to rolling cylinder engines for achieving the same function. More specifically, the present invention relates to rolling cylinder engines utilizing steam and other gases for energy generation.

2. Description of the Prior Art

Engines for produciing mechanical power are well known and come in a wide variety of forms and arrangements. Rotary engines have been particularly useful as a means for converting fuel energy to mechanical energy in an efficient manner, as compared to linear piston engines. In addition, engines utilizing steam as the conversion element have been considered highly desirable since they reduce the use of petroleum-based products and reduce pollution resulting from the exhaust gases arising from the combustion of such petroleum-based products.

U.S. Pat. No. 2,867,978 discloses one form of steam engine having a typical design. This particular engine utilizes a standard piston cylinder arrangement to generate power resulting from converting water to steam. U.S. Pat. No. 1,530,307 discloses the concept of a flash rotary engine utilized to convert water to steam, and in so doing, produce mechanical energy. However, each of these devices is relatively complicated and requires a plurality of moving and reciprocating parts. There is no known prior art use of rolling cylinder engines. Thus, there remains a need for a boilerless, substantially pollution-free rolling cylinder engines steam or other fluid engine which is simple in design, high in efficiency and which has minimal moving parts.

SUMMARY OF THE INVENTION

Accordingly, it is a principal object of the present invention to provide a rolling cylinder engine.

It is another object of the present invention to provide a steam engine which eliminates the need for a boiler, and which is extremely low in the production of environmentally polluting exhaust elements.

Yet another object of the present invention is to provide a rolling cylinder engine which is high in efficiency and which does not require the use of a separate starter motor.

To achieve the foregoing and other objects and in accordance with the purposes of the present invention, an engine for rotating an output shaft is provided. The engine includes a housing which defines an inner cylindrical surface which is coaxial with an output shaft. A roller member is disposed within the housing and has an inner cylindrical bearing surface and an outer cylindrical surface having a diameter less then the diameter of the inner cylindrical surface of the housing, and which is, but for a single line of tangential contact, substantially spaced from the inner cylindrical surface of the housing. The longitudinal central axis of the roller member is substantially parallel with, but radially offset from, the central axis of the housing and the coaxial output shaft. A plurality of two or more chambers are defined between the housing and the roller members, and devices are provided for selectively introducing expansive fluid into each of the chambers in a rotationally sequential fashion. Devices are also provided for exhaustiing expanded fluid from each of the chambers in the same rotationally sequential fashion. As a result of this introduction of fluids into and expansion of fluids within the chambers, the outer surface of the roller is urged away from the inner surface of the housing at the chamber into which the expansive fluid has been introduced. This arrangement rolls the substantially single line of tangential contact between the outer circumferential surface of the rolling cylinder and the inner circumferential surface of the housing sequentially about the inner cylindrical surface of the housing so that the central longitudinal axis of the rolling cylinder rotates about the central longitudinal axis of the housing and the coaxial output shaft. A mechanism is provided for rotating the output shaft in response to the movement of the roller member within the housing. Finally, an arrangement is provided for preventing relative rotational movement between the housing and the roller member.

These and other objects of the present invention will become apparent to those skilled in the art from the following detailed description, showing the contemplated novel construction, combination, and elements and as more particularly defined by the appended claims, it being understood that changes in the precise embodiments of the disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 7 is a rear elevational view of the engine embodiment illustrated in FIG. 2 showing details of one form of the exhaust control arrangement of the present invention;

FIG. 8 is a cross-sectional view of an end plate;

FIG. 9 is a cross-sectional view of a detached positioning and alignment bracket taken substantially along line 9—9 of FIG. 8;

DETAILED DESCRIPTION OF THE PREFERRED EMBODIMENT

Figure 1:
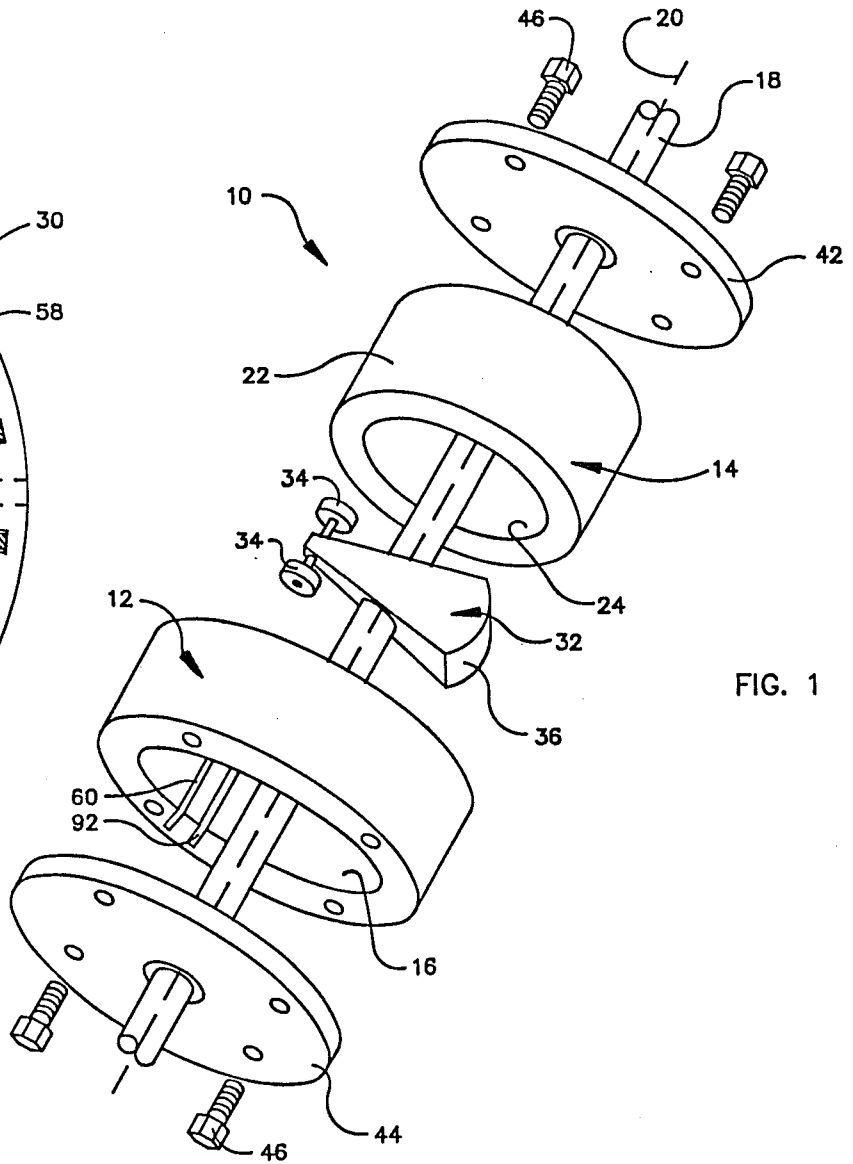
FIG. 1 is an exploded, schematic view of one simple embodiment of the engine of the present invention.

Referring initially to FIGS. 1-4, various embodiments of a rolling cylinder engine, each designated generally as 10, are illustrated. Each engine 10 includes a housing member 12 and a cylindrical member 14 disposed within that housing member 12. The exterior of housing 12 will normally be stationary and preferably includes an inner, substantially cylindrical surface 16 which defines a central cylindrical cavity 30 having an internal radius R2. The exterior of housing 12 may be of any configuration, but is also must efficiently in the form of a cylinder. Housing 12 and the other various components of engine 10 may be constructed from a wide variety of materials which are capable of maintaining their integrity at the relatively low operating temperatures of the system.

A rotatable output shaft 18 is mounted through the center of the housing 12 such that the longitudinal axis 20 of shaft 18 is located substantially in line with the longitudinal axis of housing 12. Thus, shaft 18 and housing 12 are coaxial, even though shaft 18 is mounted for rotation with respect to housing 12.

Rotary member 14 is preferably in the form of a cylinder having a substantially cylindrical outer surface 22 having an external radius R1, and having a substantially cylindrical inner bearing surface 24. In the form shown, rolling member 14 is shown as tubular in shape and as a uniform wall cross-section throughout its structure. However, so long as the inner and outer surfaces are substantially cylindrical, the cross-section does not have to be uniform. The external radius R1 of rolling member 14 is less than the internal radius R2 of housing 12 so that rotary member 14 is, but for a single line of tangential contact as detailed below, spaced inwardly from inner surface 16 of housing 12. As described in greater detail below, this arrangement enables rolling member 14 to make a rolling cycle along the inner surface 16 of housing 12, to thereby function as an engine.

Now referring to the geometry of the relationship between housing 12 and rolling member 14, a single substantially tangential line of contact 28 is provided at all times between the outer surface 22 of rolling cylinder 14 and the inner surface 16 of housing 12. As a result of this positioning and of the external radius R1 of rolling member 14 being less than the internal radius R2 of housing 12, longitudinal axis 26 of rolling member 14 is at all times radially offset from longitudinal axis 20 of housing 12. Tangential line of contact 28 will continuously move along the inner surface 16 of housing 12 as inner cylinder 14 continuously rolls along surface 16 in response to the engines motive force, as further detailed below. It should be noted, however, rolling member 14 does not rotate relative to housing 12 due to a mechanism which is also described in greater detail below. Thus, as rolling member 14 continuously rolls along inner surface 16, longitudinal axis 26 of cylinder 14 continuously rotates or revolves about longitudinal axis 20 of housing 12 and output shaft 18, thereby providing an oscillatory rolling movement of cylinder 14 relative to stationary housing 12.

A power transfer arm 32 is disposed within the central cavity 30 of cylinder 14. The power transfer arm 32 is connected to output shaft 18 for rotation therewith. A roller mechanism, preferably in the form of a pair of roller elements 34 is carried at one distal end of power transfer arm 32. Roller elements 34 are adapted and positioned to engage the inner cylindrical bearing surface 24 of rolling member 14. In order to accomplish this the length of the portion of power transfer arm 32 which carrier roller elements 34 is sized so that roller members 34 are firmly engaged against inner surface 24. A counter-balance weight 36 is carried at the distal end of power transfer arm 32 which is opposed to roller elements 34 in order to balance the weight of rolling cylinder 14 as it moves outward from its center.

Figure 2:
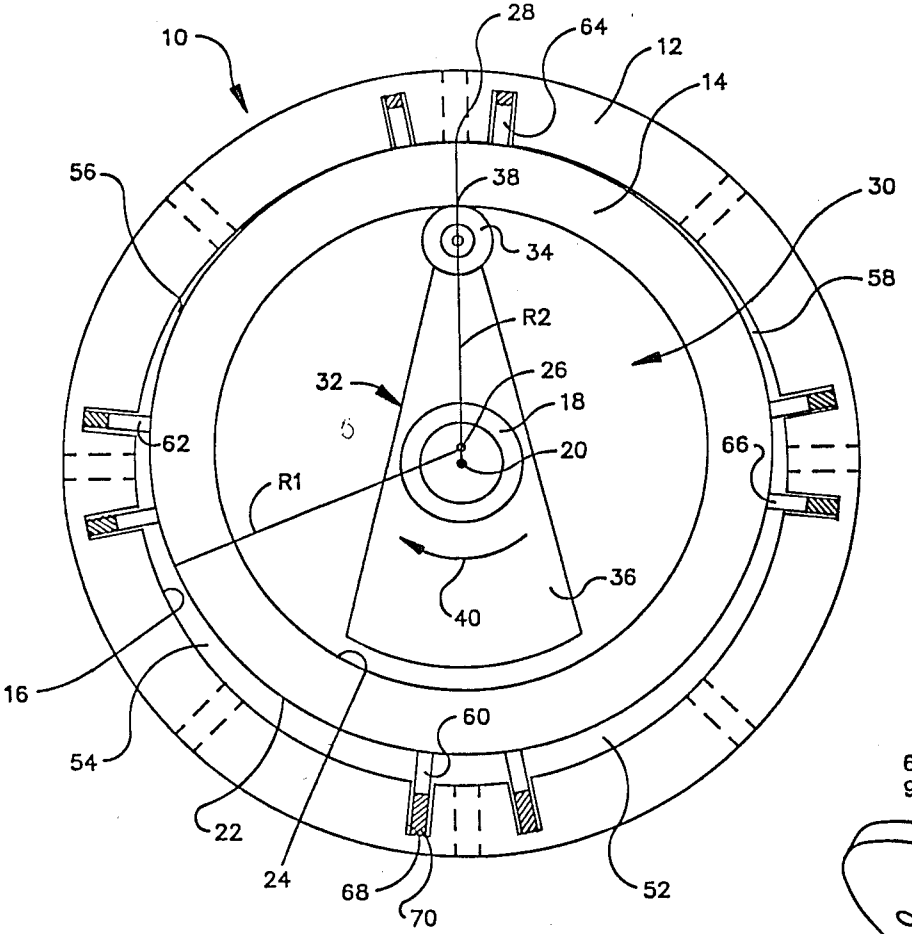
FIG. 2 is a front elevational view of the engine of FIG. 1 in assembled condition, but excluding the front cover plate therefrom.

It should be noted, as illustrated in FIG. 2, that the tangential line of contact 28 between cylinder 14 and housing 12 is aligned with the tangential line of contact 38 between roller members 34 and inner bearing surface 24 of cylinder 14. Thus, as the tangential line of contact 28 between cylinder 14 and housing 12 is caused to move along the inner surface 16 of housing 12, for example in a clockwise direction as illustrated by arrow 40, this movement in turn causes roller members 34 to rotate with the movement of cylinder 14, and thereby in turn moves power transfer arm 32 in the same clockwise rotational direction as cylinder 14. This movement of roller members 34 causes power transfer arm 32 to rotate which then in turn causes connected shaft 18 to rotate, thereby transferring the rolling motion of rolling member 14 to output shaft 18. This transfer of motion is achieved in part due to the fact that the length of transfer arm 32 is such that rollers 34 are held firmly against the inner surface 24 of cylinder 14 at line 38, while simultaneously firmly positioning the outer surface 24 of rolling cylinder 14 against the inner surface 16 of housing 12 at point 28.

Figure 18:
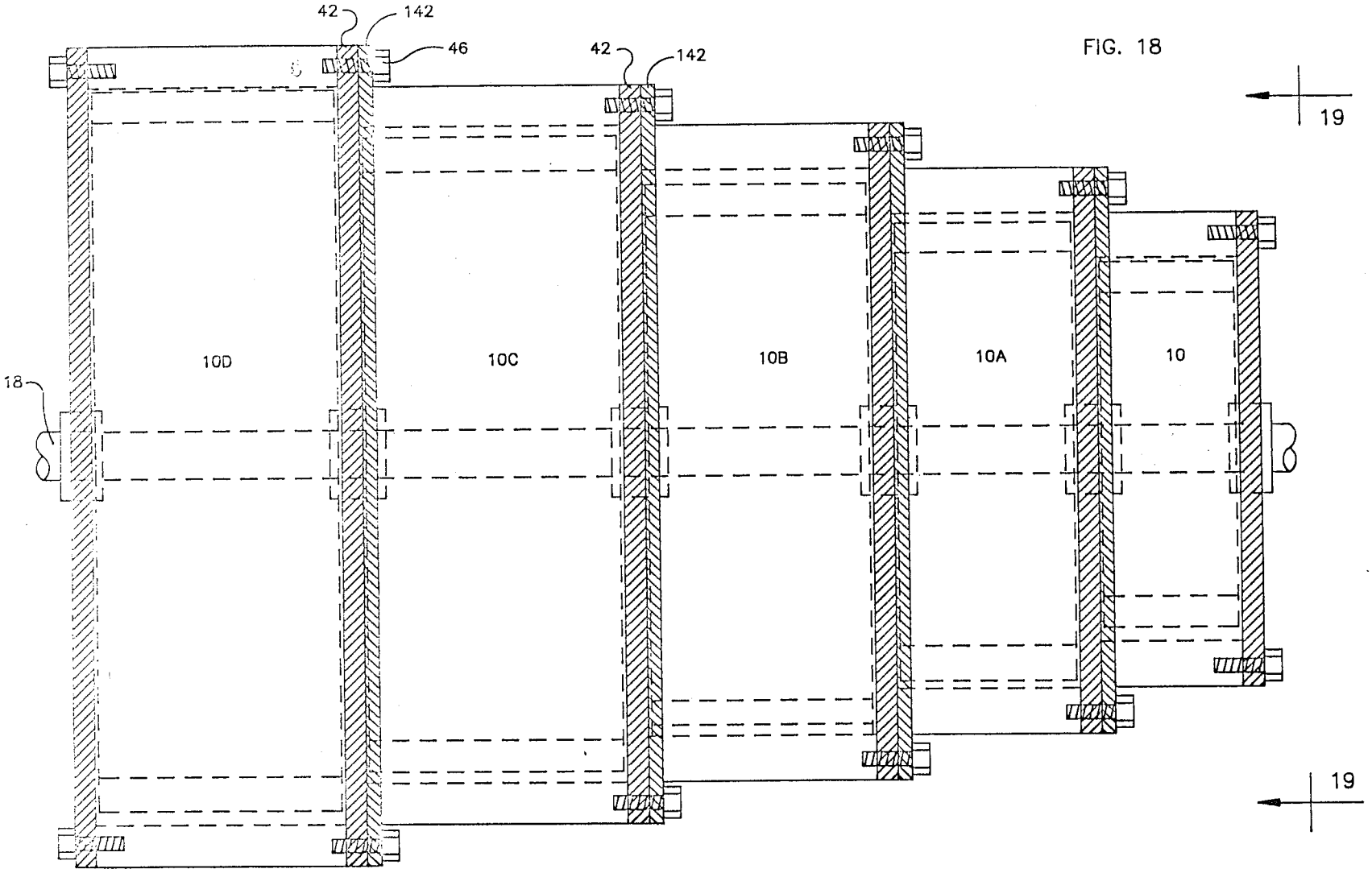
FIG. 18 illustrates stacking of a plurality of the engines of the present invention for simultaneous operation, similar to that disclosed in FIGS. 14, 15, 16 and 17.

In the preferred form of operation, as most clearly diagrammatically illustrated by FIGS. 1 and 18, end plates 42 and 44 are provided to seal housing 12. As llustrated in FIG. 1, the end plates 42, 44 are secured to housing 12 by a plurality of bolts 46, although any type of fastening mechanism may be utilized for this purpose.

It is important to the proper operation of the present invention that rolling member 14 not actually rotate relative to housing 12. Any mechanism may be utilized to prevent such relative rotational movement. However, a preferred mechanism, as clearly illustrated in FIG. 4 includes a plurality of spaced about cogs 48 which project radially outwardly from outer surface 22 of cylinder 14. To interact with and receive cogs 48 there are an equal number of cogwells or dimples 50 which are defined by and in the inner surface 16 of housing 12. Cogwells 50 are aligned with cogs 48. The depth of wells 50 and the length of cogs 48 are such that as cylinder 14 rolls along the inner surface 16 cogs 48 oscillate in and out of wells 50. However the lengths of the cogs 48 are such that two or more are at least partially engaged within a mating well 50. Thus, while cogs 48 allow for the rolling movement of cylinder 14 they prevent slippage of cylinder 14 relative to housing 12.

Figures 3, 4, 5, 6, 10, 11:
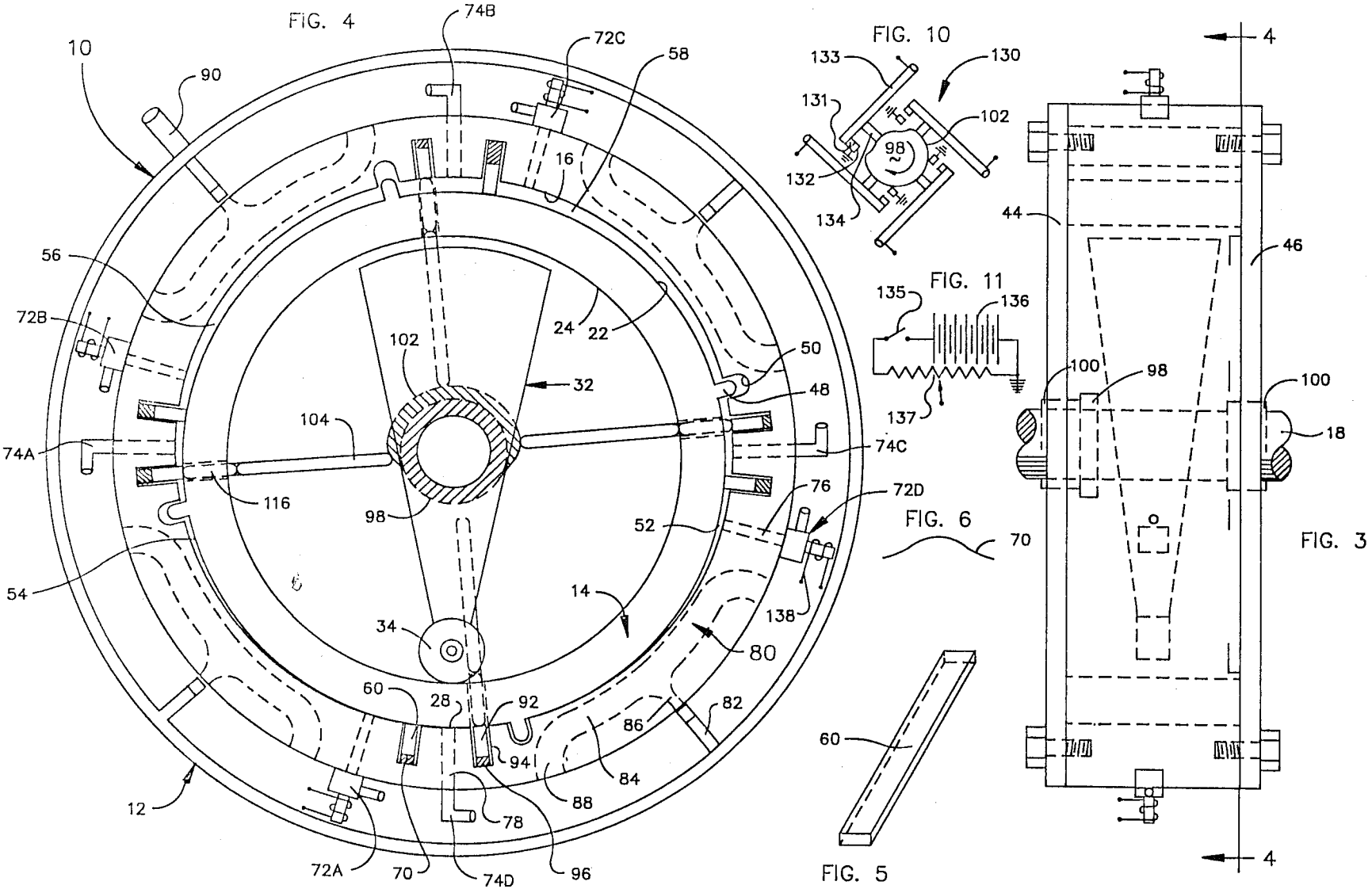
FIG. 3 is a side schematic view, with some parts in phantom, of the other embodiment of the engine of the present invention.
FIG. 4 is a partial cross-sectional view, with some parts in phantom, taken substantially along line 4—4 of FIG. 3.
FIG. 5 is a perspective view of a barrier vane utilized for chamber separation and exhaust operation of the present invention.
FIG. 6 is a cross-sectional view of a spring bias member utilized, as detailed below, with the barrier vane of FIG. 5.
FIG. 10 is a schematic of the electro-mechanical switching arrangement controlling the fluid injection operation of the engines of the present invention.
FIG. 11 is a schematic illustration of a closure circuit used in conjunction with the switching arrangement of FIG. 10.

A motive force is required to impart rolling movement to cylinder 14. This is accomplished by dividing the interior area between cylinder 14 and the inner surface 16 of housing 12 into a plurality of cavities. While any number of two or more cavities may be utilized, the illustrated embodiment shows four such cavities, 52, 54, 56 and 58. To form or define cavities 52, 54, 56 and 58, a plurality of vanes, blades or barrier members 60, 62, 64 and 66 are provided. The construction of each vane is similar and generally is in the form of a three dimensional rectilinear block. FIG. 5 diagrammatically illustrates a typical construction of a vane 60. Each vane, blade or barrier member 60, 62, 64 and 66 is positioned within one of a plurality of channels 68 disposed in and defined by the inner surface 16 of housing 12. Each channel 68 is sized and shaped and of sufficient depth so as to firmly and completely receive a vane 60, 62, 64 or 66 therewithin. This permits rolling member 14 to roll along inner surface 16 of housing 12 without impeding the rolling movement of rolling member 14.

A biasing member 70, such as a spring, is disposed within each channel 68. Each biasing member 70 normally urges and biases each barrier, blade or vane 60, 62, 64 or 66 against the outer surface 22 of cylinder 14. While any type of spring bias arrangement may be utilized, FIG. 6 illustrates a leaf-spring arrangement 70 which is the type of biasing member utilized in preferred embodiments. Each leaf spring 70 is placed in the bottom of each channel 68 so as to engage the lower surface of each barrier member 60, 62, 64 and 66 to thereby normally and continuously urge barrier members 60, 62, 64 and 66 against the outer surface 22 of cylinder 14 in a fluid-tight manner so as to form chambers 52, 54, 56 and 58 therebetween. For example, chamber 52 is defined by the space between the barrier members or vanes 60 and 66 and the outer surface 22 of rolling cylinder 14 and the inner surface of housing 12. In a similar manner chamber 54 is formed by the space between barrier members or vanes 60 and 62, chamber 56 is formed by the space between barrier members or vanes 62 and 64, and chamber 58 is formed by the space between barrier members or vanes 64 and 66, and in each instance the outer cylindrical surface 22 of rolling cylinder 14 and the inner cylindrical surface of housing 12. However, the spring bias members 70 also permit barrier members 60, 62, 64 and 66 to be compressed into their respective channels 68 as the outer cylindrical surface 22 of rolling member 14 rolls to make sequential tangential line contact with the inner cylindrical surface of housing 12 where each such barrier member is located. In the practice of the present invention the sequential movement of rolling member 14 is in response to the sequential introduction, expansion and exhaustion of fluids from the chambers 52, 54, 56 and 58 as explained in detail below.

Referring now to FIG. 4, each chamber 54, 56, 58 and 52 includes a fluid input mechanism 72A, 72B, 72C, and 72D, respectively, adapted to inject an expansive fluid of some type, such as a liquid or gas, into its associated chamber. In addition, an exhaust port 74A, 74B, 74C and 74D, is associated with each chamber 54, 56, 58 and 52 includes respectively. Exhaust ports 74A, 74B, 74C and 74D for each chamber are located at the circumferentially greatest distance from the respective fluid input members 72A, 72B, 72C, and 72C. Each fluid input member 72A, 72B, 72C, and 72D extends through a channel into its respective chamber 54, 56, 58 and 52, while exhaust ports 74A, 74B, 74C and 74D likewise extend through interior channels 78 into chamber 54, 56, 58 and 52, respectively. While any type of expansive fluid may be utilized, the preferred and illustrated embodiment utilizes water and steam.

In preferred embodiments steam or water may be directly injected through fluid input members 72A, 72B, 72C, and 72D into their respective chambers 54, 56, 58 and 52, channel 76. Subsequently heating elements, as discussed in detail below, are utilized to convert the injected water into steam within the chambers. In either event, the expansive fluid is injected into the chambers one at a time, in sequential fashion. As the fluid is injected into a chamber and is heated it expands, thus causing the chamber to expand. This in turn urges the outer surface 22 of rolling member 14 away from the inner surface 16 of housing 12 at the site of the fluid expansion in that chamber.

For purposes of explanation and illustration, the operation of one chamber 52 will be described in detail. It is to be understood that the remaining chambers of device 10 operate in the same manner in rotationally sequential fashion so that each chamber 52, 54, 56 and 58 is sequentially expanded and then contracted in a rotating manner so as to continue to roll cylinder 14 about internal surface 16 of housing 12. Referring now in particular to chamber 52, it and every other chamber is preferably heated through the use of associated heating elements 80 adjacent the chambers, as shown in phantom in FIG. 4. Heating element 80 may be of any appropriate state-of-the-art type, such as an electric resistance coil, or the like. However, a natural gas or propane fired system is preferred. In the illustrated embodiment, a fuel burner 82 is provided and communicates with a flame chamber 84 adjacent chamber 52. Flames from burner 82 are introduced to chamber 84 through an inlet 86, and the exhaust materials are removed from chamber 84 through a fuel exhaust 88. Fuel is introduced to each flame burner 82 through a common fuel supply 90. Thus, the housing 12 and each chamber is initially heated to an appropriate and desired threshold temperature, which in this instance is approximately 550° F. in order to convert water to steam under pressure, say to about 1000 psi within expandable chambers 52, 54, 56 and 58. Once housing 12 has been raised to the appropriate threshold temperature, water is injected through fuel injection member 72D into chamber 52. As water is introduced into chamber 52, it is converted to steam and expands within chamber 52. As the steam expands it sequentially urges the outer cylindrical surface 22 of cylinder 14 away from internal cylindrical surface 16 of housing 12 at the site of chamber 52, thereby rotating tangential line of contact 28 between housing 10 and cylinder 14 on towards the next chamber 54. The expanded steam in chamber 52 is then exhausted through exhaust port 74 so that chamber 52 is then ready for its next injection and expansion sequence. However, a mechanism is provided to enable the steam pressure within chamber 52 to build up momentarily to move cylinder 14 away from housing 12 at chamber 52. In order to achieve this, exhaust port 74 is temporarily blocked during the injection and expansion sequence. The preferred mechanism for achieving this function in coordination with the other chambers of device 10 is described in more detail below.

As indicated above, the exhaust port 74 must be temporarily blocked to permit fluid pressure to build up sequentially within chambers 52, 54, 56 and 58. The preferred manner of achieving this blockage includes a plurality of exhaust vanes 92 which are sized and shaped similarly or even identically of barriers or vanes 60, 62, 64 and 66 which define chambers 52, 54, 56 and 58. Likewise, a plurality of channels 94 are provided and defines in housing 12 to firmly receive and engage exhaust vanes 92. A bias member 96, such as a spring, is provided between each exhaust vane 92 and the bottom of each channel 94 for the purpose of urging and biasing exhaust vanes 92 against the outer surface 22 of rolling cylinder member 14. The exhaust vanes 92 remain in continual contact with the outer surface 22 of cylinder 14 until they are moved away from the surface 22 by a camming arrangement described below. Thus, as the fluid within chambers 54, 56, 58 and 52 sequentially expands, exhaust ports 74A, 74B, 76C or 76D are sequentially blocked until such time as the associated exhaust vane 92 is moved away from surface 22 of cylinder 14, at which time the expanded fluid is then allowed access to exhaust port 74A, 74B, 74C or 74D in that chamber and passes therethrough. As a result, pressure is reduced within that particular chamber, and thereby allows the tangential line of contact between the outer cylindrical surface 22 of cylinder 14 and the inner cylindrical surface 16 of housing 16 to continue its sequential rotational movement.

Referring particularly to FIGS. 3, 4 and 7–9, a camming and push-rod arrangement is provided to permit selective sequential opening of the exhaust vanes 92. In the preferred form shown, a cam 98 is mounted about output shaft 18. The output shaft 18 is journaled through each end plate 44, 46, for example by bearing members 100. As shown, cam member 98 is positioned against one bearing member 100 proximate the inner surface of end plate 44. The cam member 98 includes a camming surface 102 which is shaped according to the number of cavities is provided within device 10 as well as the desired timing of the sequential operation as described below.

Each exhaust vane 92 is mechanically connected to cam 98 through a push rod arrangement, generally 104. More specifically, a first radial push rod member 106 is mounted within a positioning and alignment bracket 108 on the inner surface of end plate 44. Bracket 108 is mounted to end plate 44 by appropriate fastening members 110. The radially inner end 112 of first push rod member 106 engages camming surface 102 of cam 98, while the radially outer end thereof 114 projects beyond bracket 108. A second radial push rod member 116 links the outer end 114 of the first push rod member 106 with exhaust vane 92 and passes through a channel 118 in the rolling member 14. Thus, as camming surface 102 engages and moves the inner end 112 of the first push rod 106, the second push rod 116 is caused to press against and move exhaust vane 92 into its channel 94 away from contact with surface 22, thereby allowing the expanded fluid in that chamber to access its associated exhaust port 74. When camming surface 102 is not in an engaged position with push rod 106, bias member 96 urges exhaust vane 92 against the outer surface 22 of cylinder 14 thereby closing the chamber's access to its associated exhaust port 74.

As can be seen from this arrangement, the exhaust vanes 92 of each of the chambers 52, 54, 56 and 58 can be selectively opened and closed depending upon the camming arrangement provided. It should be noted that two push rods 106, 116 are preferred rather than a singular push rod arrangement due to the fact that the oscillatory motion of rolling member 14 is rolling around a constantly changing center within housing 12 would bend a singular push rod which is mounted witin a bracket 108 and also within cylinder 14. Utilizing the present arrangement, the junction 120 between push rod members 106, 116 permits a slight pivoting movement between these two members to accommodate the oscillatory motion of rolling member 14. As can be seen from this arrangement, the shape of the cam can be varied to give selectively desired push rod 106 interaction.

Referring now to FIG. 10, the operation of fluid injectors 72A, 72B, 72C and 72D is shown to be controlled by a make and brake contact mechanism 130. Such a contact mechanism 130 is provided for each injector. For example, a pair of electrically grounded contact points 131 and 132 are provided at the end of a pivotally mounted and electrically insulated from ground contact arm 133. Each contact arm 133 is pivotally mounted against pivot arm 134 which is also insulated from ground which in turn engages the surface of cam 98. As can be seen from FIGS. 10 and 11, when pivot arms 134 are in contact with camming surface 102, as illustrated in three of the four positions of FIG. 10, contact points 131 and 132 are separated and opened. However, when cam surface 102 is not engaged with pivot arm 134, contact arm 133 pivots and allows mechanical and electrical contact between points 131 and 132. This engagement closes switch 135 (FIG. 11) and allows electrical power from a source such as battery 136 through potentiometer 137 to activate fluid injector 72 through circuitry 138 (FIG. 4). When fluid is injected, for example from injector 72D into heated chamber 52, gas is produced and expands within chamber 52. This expansion urges the outer surface of cylinder 14 away from the inner surface of housing 12 at the site of injector 72 of chamber 52 and thus causes rolling member to sequentially roll and decrease the volume of the adjacent cavity 54. In this embodiment in which there are four chamber, as cylinder 14 rolls, power transfer arm 32 is caused to rotate about 90° thereby rotating output shaft 18 and cam 98. Rotation of cam 98 causes fluid injector 72A of cavity 54 to be activated (see FIG. 12A) and thereby continues in a sequential rotational action which continually rotates output shaft 18.

Referring now to FIGS. 4, 10, 12A, 12B, 12C and 13A, 13B, 13C, now that the operation of the various elements of engine 10 have been described, the integrated operation of the entire engine 10 can be described. For the purpose of explaining the operation of the invention, it is assumed that the required heat for vaporizing the injected fluid is produced by the combustion of a clean burning and controllable hydrocarbon gas, such as propane gas. In fact, any other controllable fuel such as alcohol, butane gas, gasoline, heating oil, hydrogen gas, and the like may be utilized. However, the engine may become completely pollution-free only of the required heat is produced by the combustion of hydrogen and pure oxygen is used. If oxygen taken from the atmosphere is burned with hydrogen polluting nitrous oxide would be produced. In its preferred form, water will be injected and steam will be produced at the desired pressure within the expansion chambers 52, 54, 56 and 58 by this heating operation. However, the vapor of any volatile liquid or any other expandable fluid will operate engine 10.

Water injectors of various kinds have been around since the advent of steam engines, and fuel injectors of various designs are in common use in the operation of diesel engines. Thus, any desirable art known injection mechanism may be utilized with this invention. To simplify the explanation of the present invention and to provide instant starting without a separate electric starter motor, since engine 10 will always stop in a position at which it is ready to start, electromagnetically energized injectors 72 are preferably utilized in conjunction with make and brake contact mechanism 130.

Figures 12A, 13A:
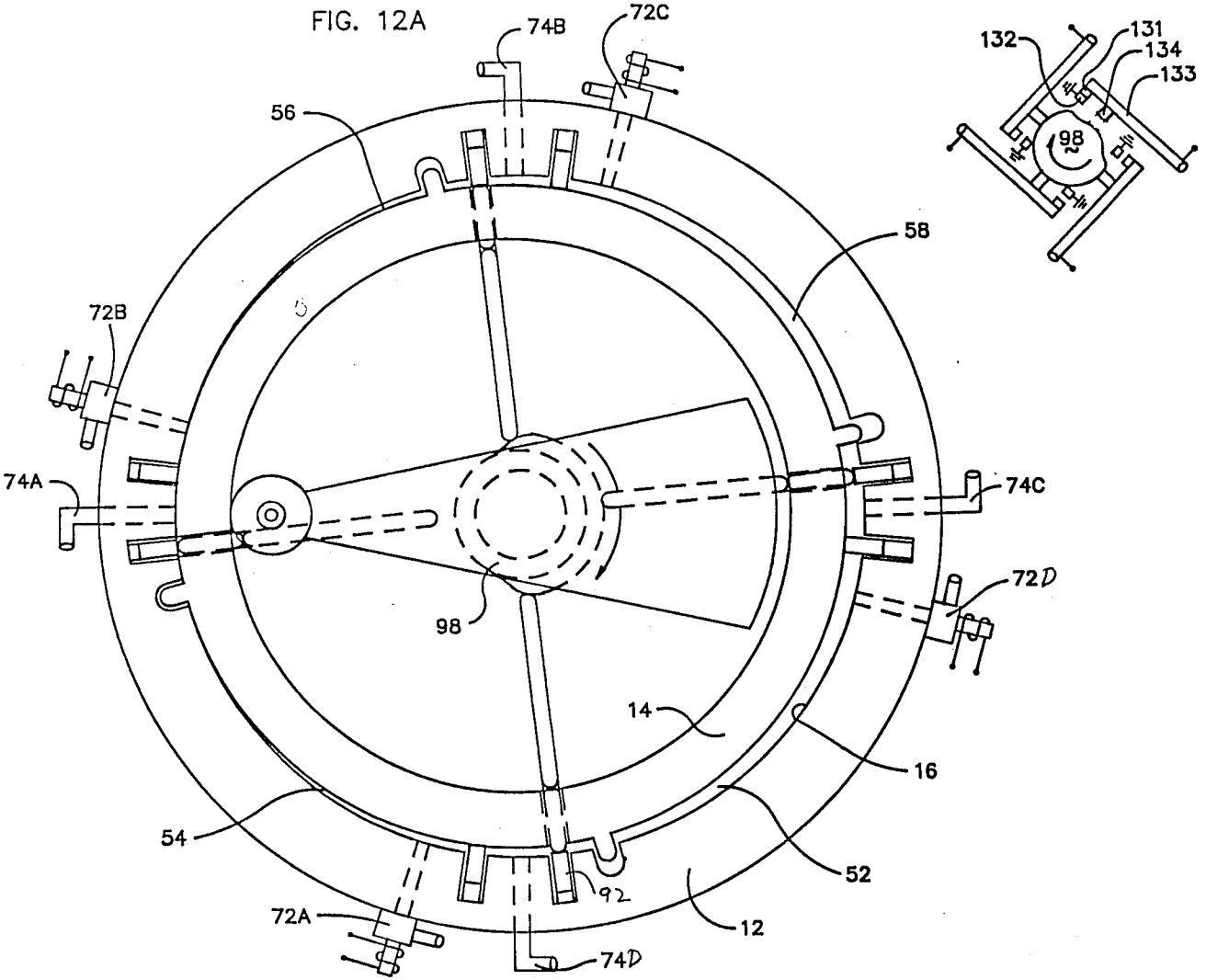
FIGS. 12A, 12B and 12C illustrate an embodiment of an engine similar to that of FIG. 4, which sequentially illustrates the relationship of the components thereof as the oscillating member oscillates to various positions while making a cycle within the housing of the embodiment illustrated therein.
FIGS. 13A, 13B and 13C illustrate the condition of the fluid injection switching arrangement of FIG. 10 as it will correspond to the condition of the embodiments illustrated in FIGS. 12A, 12B and 12C, respectively.

Assuming that the stationary housing 12 is heated to approximately 550° F., approximately 1000 pounds per square inch (psi) of steam pressure within the expansion chambers 52, 54, 56 and 58 will be provided when a predetermined amount of atomized water is injected into one of the chambers 52, 54, 56 and 58 as each chamber reaches the point in the sequence where it is required to move the outer surface of cylinder 14 away from the inner surface of housing 12 at the site of that chamber. Referring to FIG. 4, assume that cylinder 14 has made at least one complete cycle within housing 12 so that steam is just ready to be exhausted from export port 74C from expansion chamber 58. At this point in the sequence, injector 72D is then energized to inject atomized water into expansion chamber 52. This expansion of steam within expansion chamber 52 urges outer surface 22 of cylinder 14 away from the inner surface 16 of housing 12 and thus rotates the tangential contact line 28 between cylinder 14 and housing 12 clockwise to a point in chamber 54 as illustrated in FIG. 12A. The cam surface 102 of cam 98 is holding exhaust vane 92 of expansion chamber 58 away from the outer surface 22 of rolling member 14, thus allowing steam within expansion chamber 58 to exhaust through exhaust port 74C.

In viewing FIG. 12A, cam 98 is seen to have advanced approximately 90° to the position illustrated therein, and the contact points for injector 72D have been separated and opened, thereby shutting off injector 72D. Moreover, contact points 132, 131 for injector 72A have now been closed, thereby energizing and activating injector 72A. Thus, injector 72A now injects atomized water into expansion chamber 54. Meanwhile, cam 98 is urging exhaust vane 92 of chamber 52 away from the outer surface of rolling member 14 so that steam within expansion chamber 52 can now exhaust through exhaust port 74D into the atmosphere. Meanwhile, the atomized water which has been injected into chamber 54 has been heated and expanded to increase the pressure within expansion chamber 54 and thereby forces rolling member 14 to continue its clockwise rolling motion to sequentially advance tangential contact line 28 to another position as illustrated in 12B. Moreover, each position that cylinder 14 is advanced causes power transfer arm 32 to rotate thereby rotating the power output shaft 18 and cam 98.

Figure 13B:
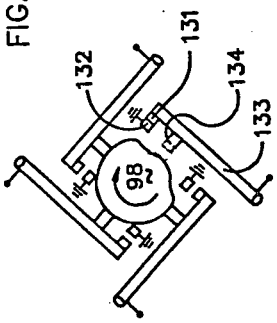
Figure 12B:
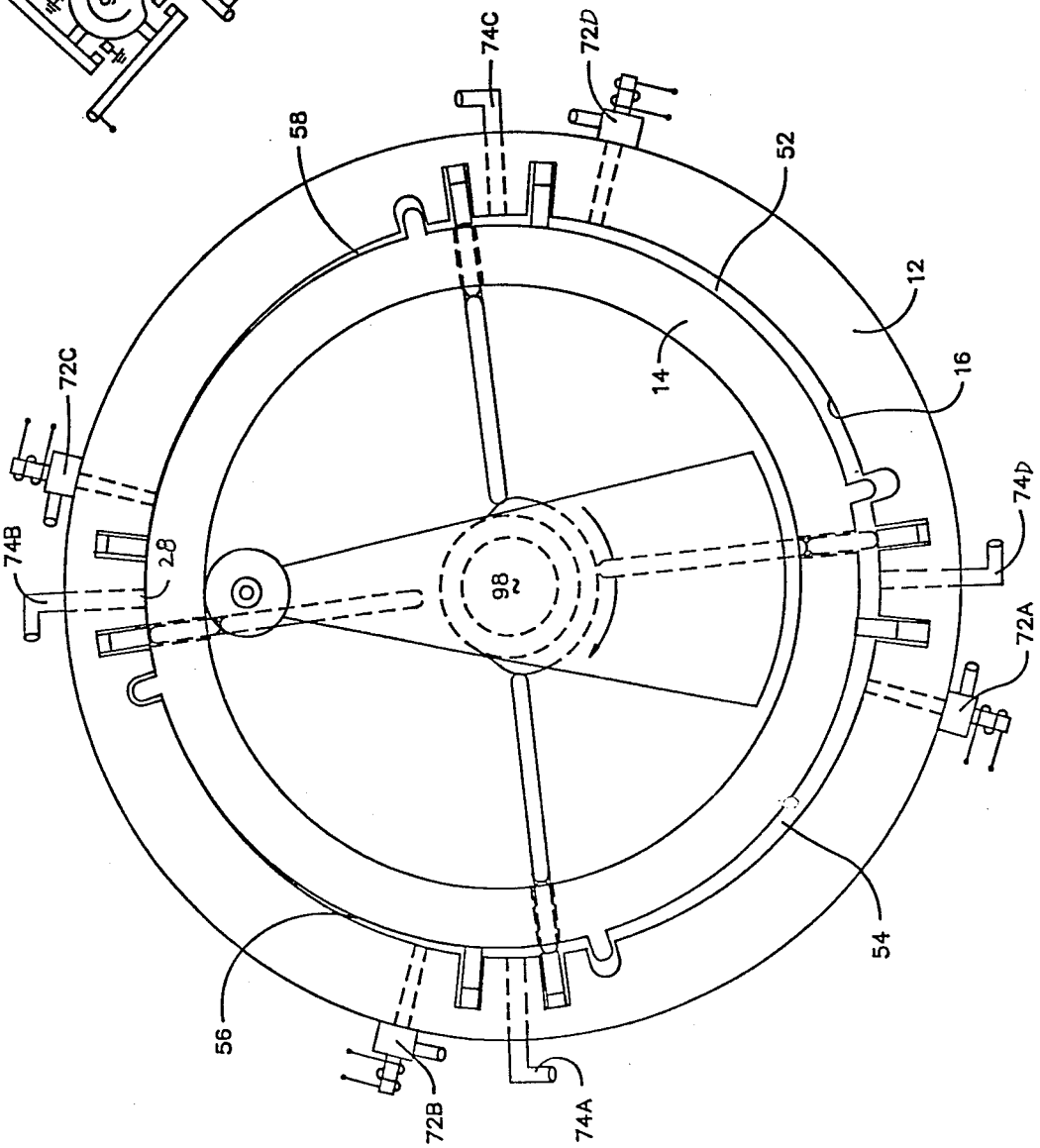
Figure 13C:
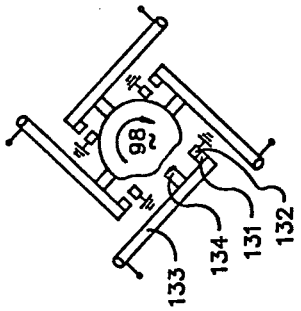

Referring now to FIGS. 12B and 13B, cam 98 and rolling member 14 are shown to have advanced yet another full 90°. In so doing, contact points 131 and 132 controlling fluid injector 72A have opened, thereby deactivating that injector, while the two contact points controlling injector 72B have now been closed, thereby activating water injector 72B and as a result producing steam within expansion chamber 56. Simultaneous with this action, can surface 102 of cam 98 has been rotated so as to force exhaust vane 92 of chamber 54 inwardly away from the outer surface 22 of rolling member 14 thereby allowing steam within expansion chamber 54 to exhaust through exhaust port 74A into the atmosphere. As the steam is produced within expansion chamber 56, pressure therein mounts and urges the outer surface of rolling member 14 away from the surface 16 of housing 12 at the site of expansion chamber 56 thereby continuing the rotating movement of tangential contact line 28.

Figure 12C:
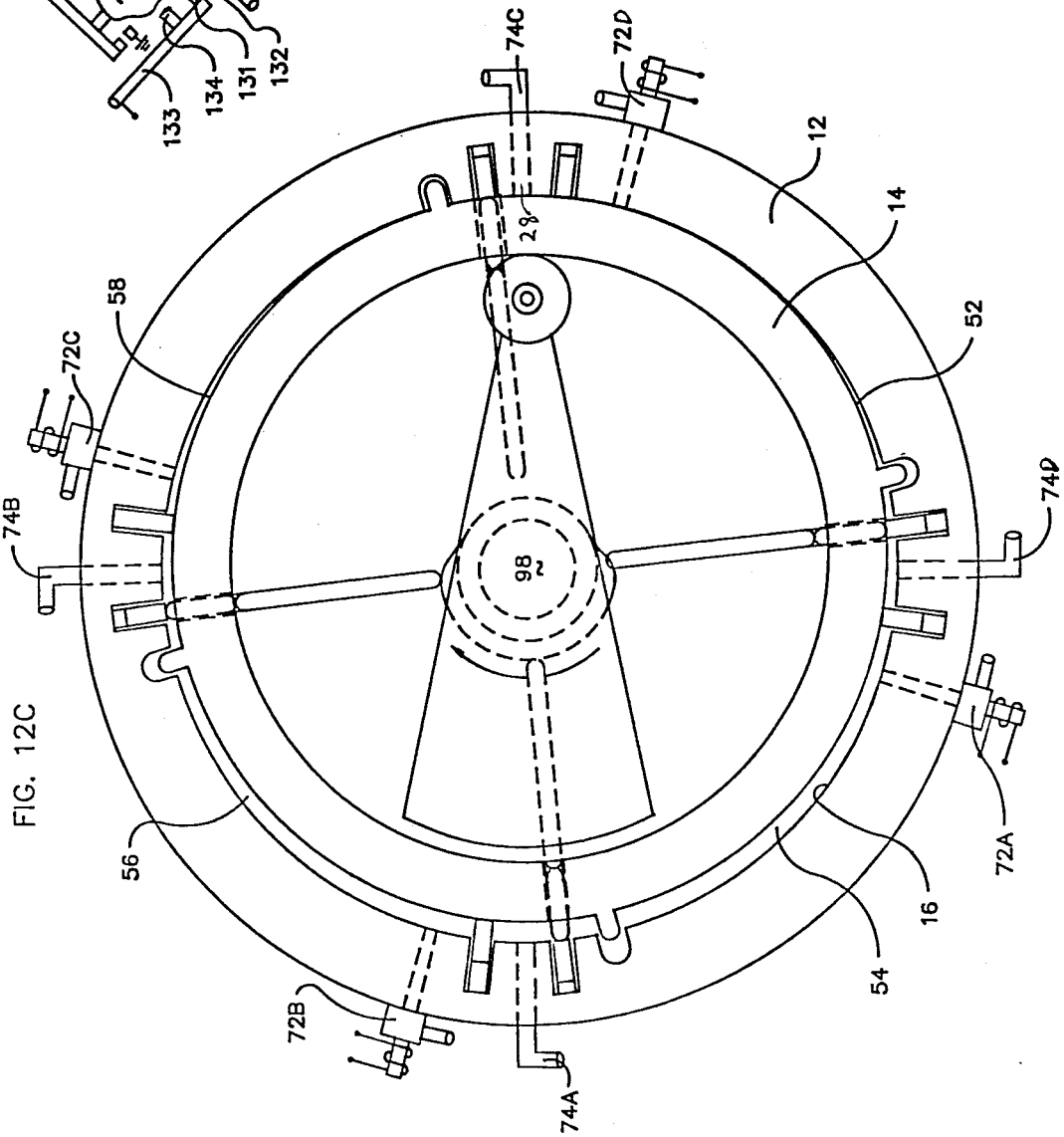

Referring now to FIG. 12C, cam 98 and rolling member 14 are shown to have rotated still another full 90°. Contact points 131 and 132 controlling fluid injector 72B have now been opened thereby, deactivating fluid injector 72B, while two contact points 131 and 132 of fuel injector 72C have not been closed. This activates fluid injector 72C and permits steam to be produced within expansion chamber 58. Simultaneous with this action, cam surface 102 of cam 98 has urged exhaust vane 92 of chamber 56 inwardly to permit the steam within chamber 56 to escape into the atmosphere through exhaust port 74B thereby reducing the pressure within chamber 56. As the pressure within chamber 56 is reduced, the pressure within chamber 58 is increased by the introduction of water into that chamber, which when heated results in the production of pressurized steam therein. Meanwhile the production of steam within heated chamber 58 increases the pressure within that chamber and causes the outer surface of rolling member 14 to be urged away from the inner surface of housing 12 at the site of chamber 58 and thereby causes tangential line 28 to continue its sequential rolling movement in a clockwise direction, which in turn causes the simultaneous rotational movement of power transfer arm 32 and output shaft 18.

This concludes the description of a full cycle at which point cylinder 14 and power transfer arm 32 return to the positions originally illustrated in FIG. 4. This sequential operation or activation of fuel injector 72D, 72A, 72B, 72C in conjunction with opening and closing of exhaust ports 74D, 74A, 74B and 74C permits continued sequential rolling movement of tangential contact line 28 between rolling cylinder 14 and housing 12 in the manner described above.

Figure 14:
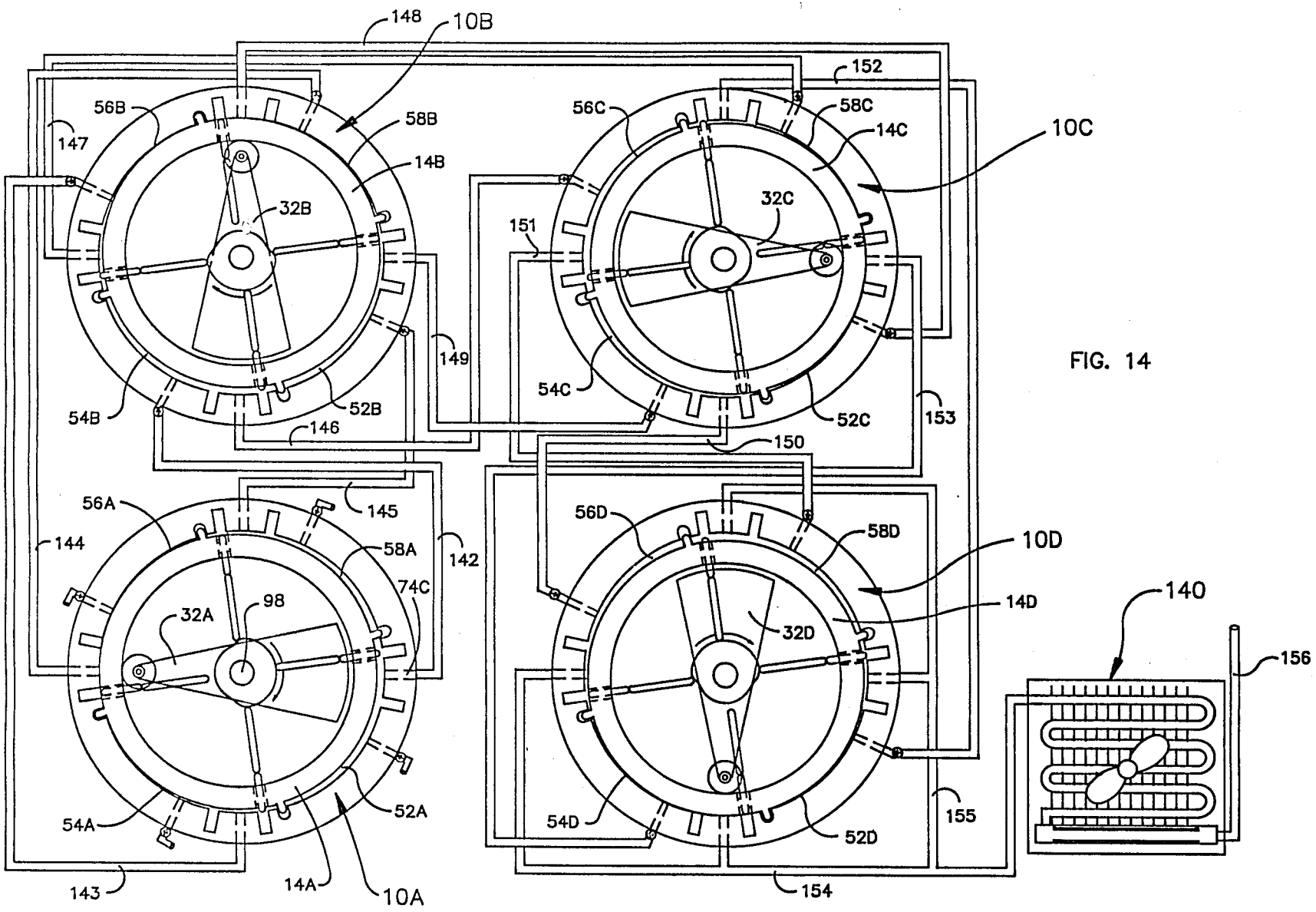
FIG. 14 illustrates a system in which a plurality of engines of the present invention are interconnected in series for simultaneous operation and with pressure drops between each of the engines.
Figure 15:
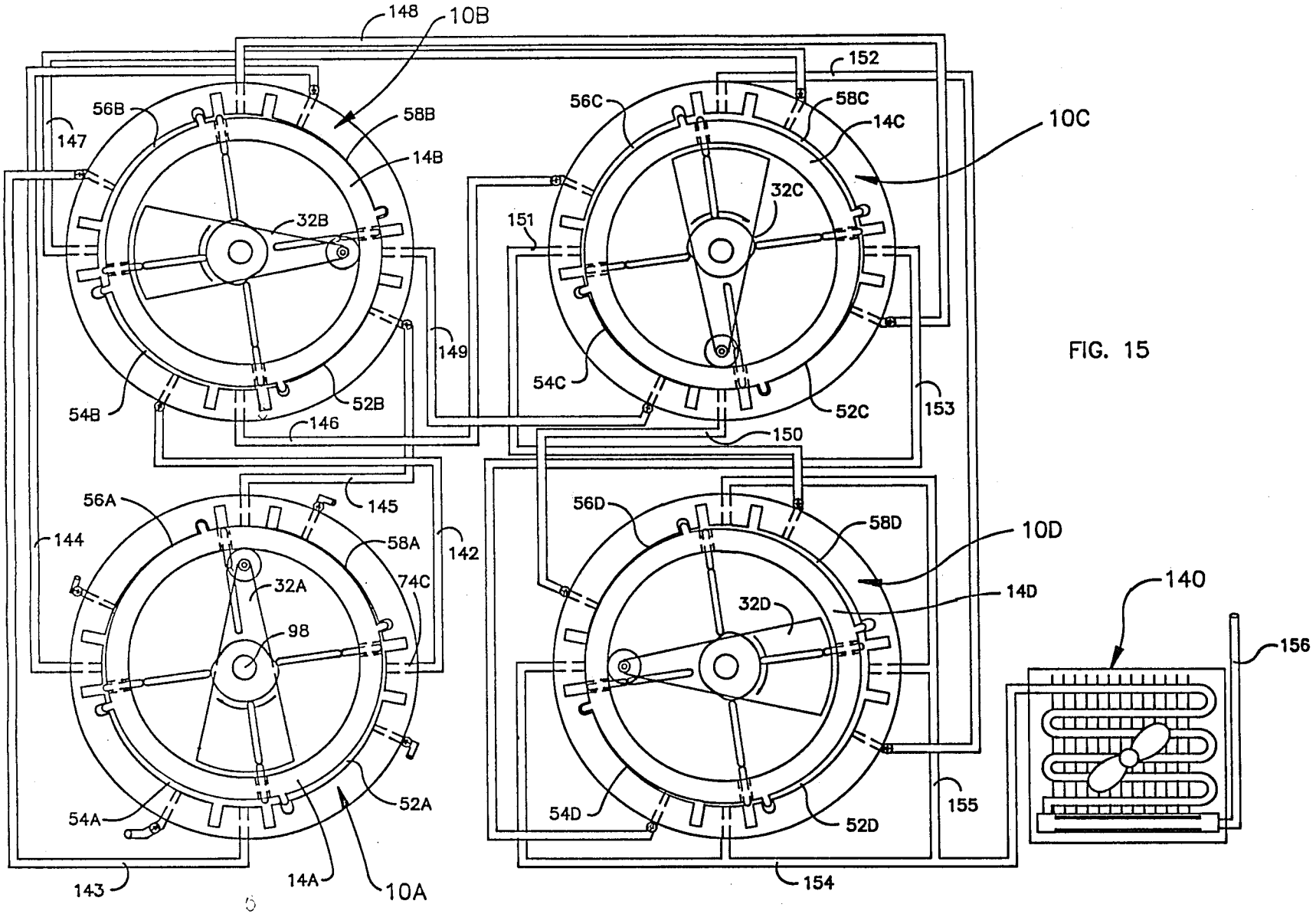
FIGS. 15, 16 and 17 illustrate the plural engine arrangement of FIG. 14 but showing sequential positioning of each oscillating member of each engine as it advances through a cycle thereof.
Figure 16:
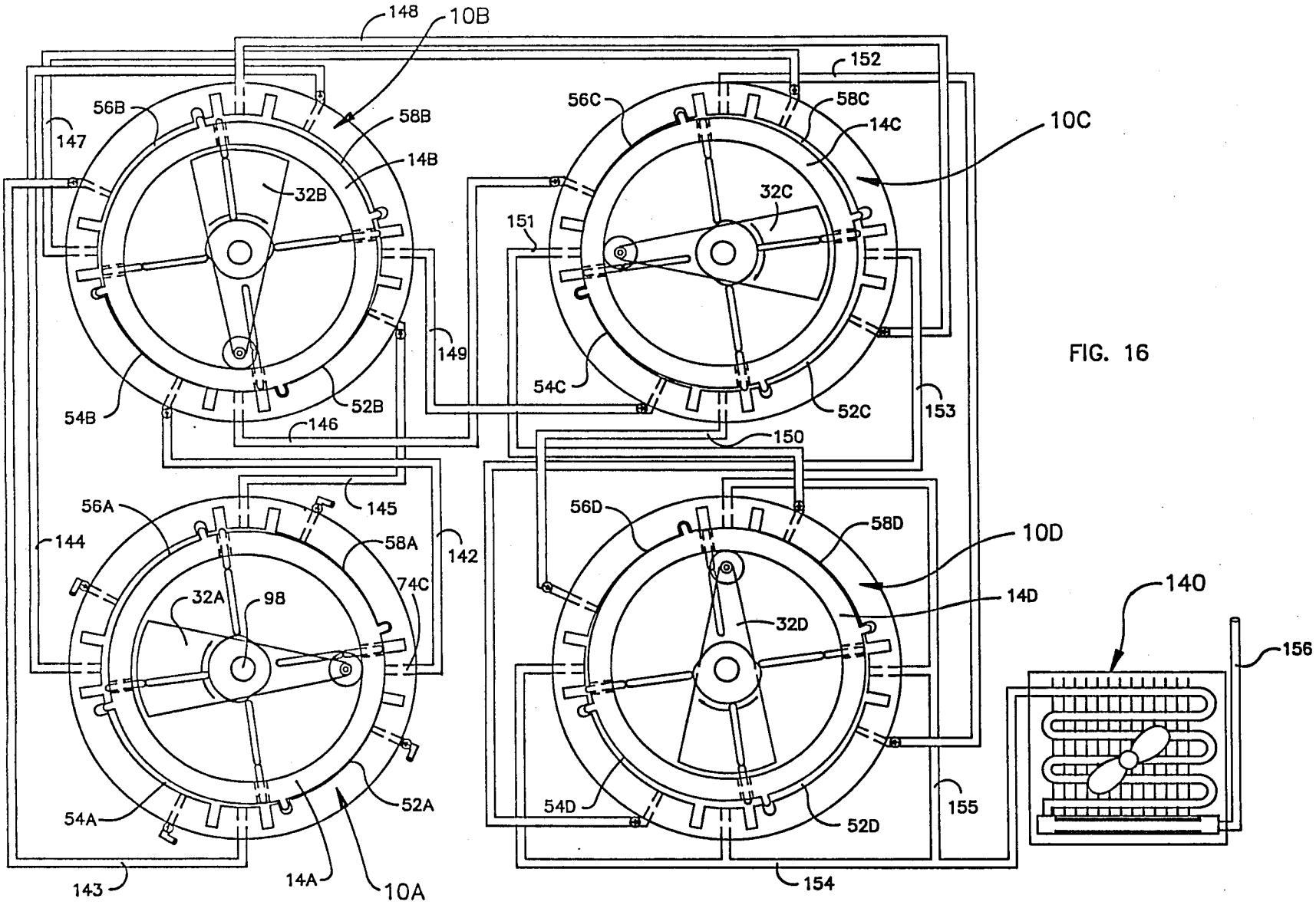
Figure 17:
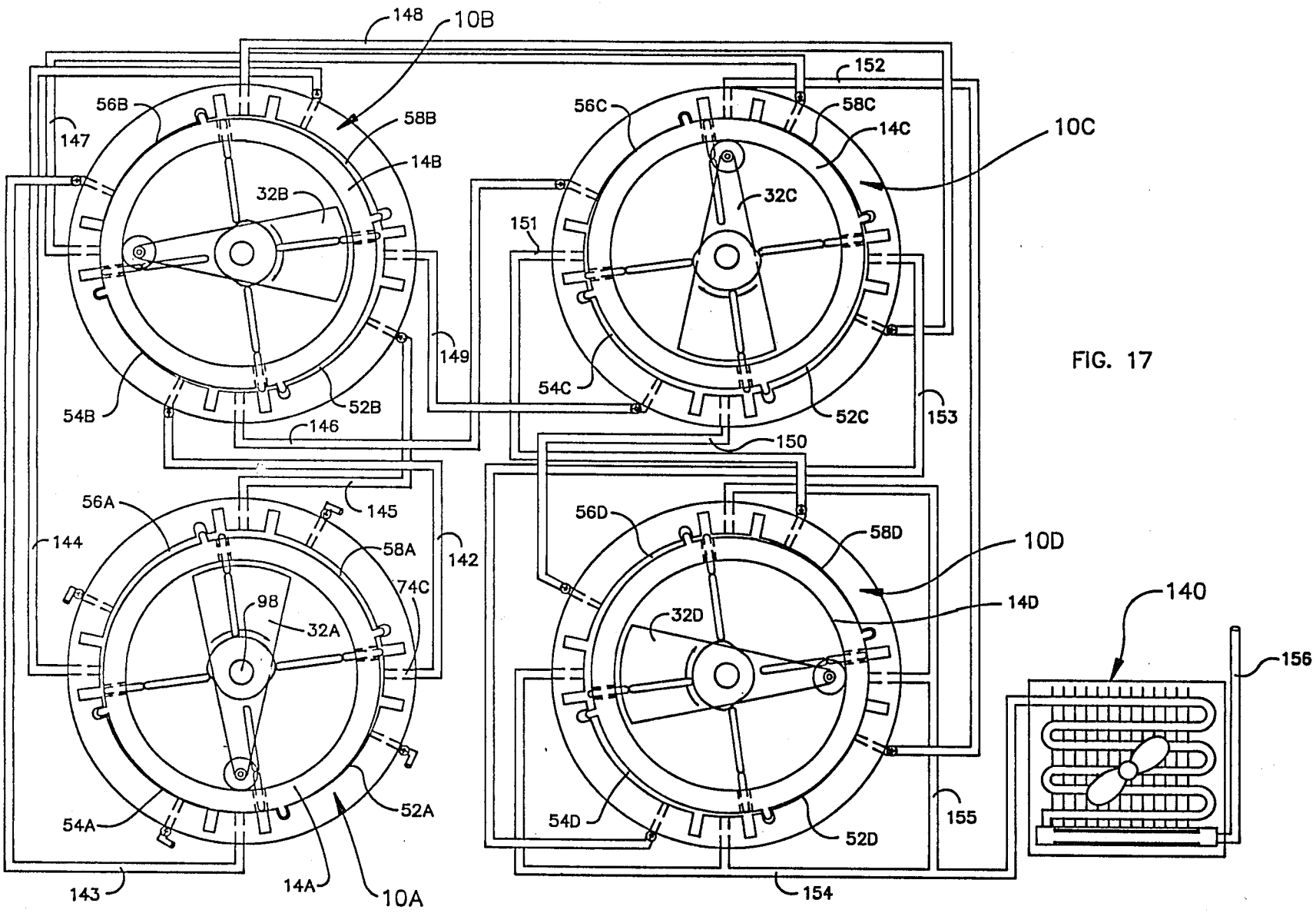

It is clear from the above that engine 10 can readily operate as an independent steam engine. However, the efficiency thereof can be increased by operating a plurality of such units together to rotate a common shaft to take advantage of the discharged steam from each exhaust cycle. Referring now to FIGS. 14–19, making better use of all of the steam generated and to create a closed system wherein no steam is exhausted into the atmosphere can be accomplished by directing the exhaust steam from the expansion chambers of steam engine 10A to engine 10B and so forth. Thus, only unit 10A of FIG. 14 is required to include heating elements 80 of the type illustrated in FIG. 4. The exhausted steam from unit 10A is directed to unit 10B. There is no need for heating elements in unit 10B since the steam from 10A is still in a heated and expanded state. Likewise, and the exhaust steam from unit 10B is directed to the inlet ports of unit 10C, and the exhaust steam from unit 10C are likewise directed to the inlet ports of unit 10D. The exhaust steam from unit 10D is then directed to a condenser 140 of any desired design, wherein the exhausted steam is condensed, changed to water and then recirculated back to the injectors of heating element of unit 10A. This results in a closed system, and therefore the reduced pressure of the ultimate exhaust to condenser 140 is provided for safety purposes. For purposes of efficiency in a stacked unit, the pressure of the exhaust steam is reduced as it advances from one expansion chamber to the next connected expansion chamber of the subsequent unit. This is accomplished by increasing the volume of the expansion chamber of the next sequential unit to which it is connected. As is well known, the volume of each sequential chamber may be increased by increasing any one or more of the dimensional parameters of the chamber.

Referring to FIGS. 14–17 in more detail, assume unit 10A is heated to approximately 550° F. and injected with a measured amount of water, as described above so that the pressure within each of its various expansion chambers 52, 54, 56 and 58 will be approximately 1000 psi. In a four chamber unit the steam pressure created within the first expansion chamber 52 sequentially advances tangential line 28, cam 98 and power transfer arm 32 about 90°, as previously described. Simultaneous with this, steam is being sequentially exhausted from chambers 58A, 52A, 54A and 56A through exhaust ports into expansion chambers 58B, 52B, 54B and 56B, of unit 10B. Remember that as power transfer arm 32 and rolling member 14 of unit 10 rotates, the rolling cylinders 14A–14D and the power transfer arms 32A–32D of units 10A–10D also simultaneously rotate and advance 90°. Steam from expansion chambers 58A, 54A, 56A and 52A are likewise directed through piping 142, 143, 144 and 145 to inlet ports for expansion chambers 52B–58B. In a like manner, the exhaust from chambers 52B–58B are likewise directed through piping 146–149 to expansion chambers 52C–58C of unit 10C. In a similar manner, the exhausted steam from chambers 52C–58C are directed through piping 150–153 to chambers 52D–58D of unit 10D. Finally, the exhaust from expansion chambers 52D–58D is directed through piping 154 and 155 to condenser 140, and the water condensed from the steam in condenser 140 is directed through piping 156 back to fluid injectors 72 of unit 10.

As can be seen from FIGS. 4 and 14–17, units 10, 10A, 10B, 10C and 10D operate simultaneously each advancing an equivalent number of degrees through its own cycle. In preferred form, the units are set so as to be operating an equal increment of degrees out of phase from each other. For example, there are four units illustrated in FIGS. 14–17. In this instance, each unit 10A–10D would preferably operate 90° out of phase from the two adjacent units. As indicated above, there is a reduction in steam pressure as the exhaust steam moves from unit to unit in the embodiments illustrated in FIGS. 4 and 14–17. This pressure reduction can be calculated in a manner described below.

To calculate pressure reduction in the arrangement in FIGS. 4 and 14–17 (i.e., using five engine units), the following is first assumed;

1. That stationary housing 12 of unit 10 has been heated to 550° F. so that the pressure within expansion chamber 52, now delivering power, and within expansion chamber 58 that is just ready to exhaust, will be approximately 1,000 psi.;

2. That the inside diameter R2 of stationary housing 12 is 8";

3. That the outside diameter R1 of rolling member 14 is 7¾ inches;

4. That the distance between the exhaust vane 92 and each adjacent barrier member 60, 62, 64 and 66 adjacent to exhaust ports 74 of all the units is one inch.

5. That the axial length of unit 10 is 3 inches;

6. That the average distance between the outer surface 22 of rolling member 14 and the inner surface 16 of stationary housing 12 is 3/16 inch for all expansion chambers 52, 54, 56 and 58 at the time any given expansion chamber is just ready to exhaust; and 7. That the roller bearing member 34 in unit 10 has already made one complete revolution so that there is steam within the expansion chamber 58 ready to exhaust.

The length of each expansion chamber of unit 10 will be 8 (the inside diameter of stationary housing 12)×3.1416 (Pi, the ratio of the circumference of a circle to its diameter) divided by 4 (the number of expansion chambers in unit 10. Could be more in larger diameter units.) minus 1 (the space between vanes 92 and 60 adjacent to exhaust ports 74). That equals [(8 inches×3.1416)/4−1]=5.2831 inches. The surface area within each unit 10 expansion chamber, against which the 1000 psi of steam pressure will be acting will be 5.2831 inches×3 inches=15.8496 square inches.

The volume within each expansion chamber of unit 10 at the beginning of an exhaust period will be 5.2832 inches×3 inches×3/16 inch=2.9718 cubic inches.

The total pressure within expansion chamber 52 acting to force roller 34 to advance to the position shown in FIG. 4 at the instant expansion chamber 58 is just ready to exhaust will be 1000×15,8496=15,8496 pounds. For now, disregard the fact that pressure within expansion chamber 58 is also forcing roller 34 to advance.

For unit 10A, FIG. 14, assume the following:

1. The inside diameter of stationary housing 12 is 12 inches;

2. The length of unit 10A is four inches; and

3. The surface area within expansion chamber 54A of unit 10A, against which pressure is acting will be [(12 inches×3.1416)/4−1]×4 inches=33.6992 square inches.

The volume of space within each expansion chamber of unit 10A is [(12 inches×3.1416)/4−1]×4 inches×3/16 inches=6.3186 cubic inches. As steam exhausts from expansion chamber 58 of unit 10, FIG. 4, through pipe 142 into expansion chamber 54A of unit 10A, FIGS. 14–17, it will then occupy, as rotation continues, a total volume of 2.9718 cubic inches+6.3186 cubic inches=9.2914 cubic inches.

Pressure will then be reduced to (1,000×2.978)/9.2914=320.511 psi.

The total pressure within expansion chamber 58 of unit 10 and within expansion chamber 54A of Unit 10A, forcing rotation of shaft 18 due to the reduced pressure of 320.511 psi will be 320.511×(15.8496+33.6992)=15,881 lbs.

This is 15,881 pounds of pressure which supplements the 15,849 pounds of pressure now generated within expansion chamber 52 of unit 10, FIG. 4, so that the actual total pressure forcing rotation of shaft 18 will, be about 31,700 pounds from expansion chambers 58, 52 and 54A only, disregarding existing pressure within expansion chamber 52A of unit 10A.

For the balance of the calculations of pressure reduction, only the action of reduced pressures will be considered.

For unit 10B, FIGS. 14–17, assume the following:

1. The inside diameter of stationary housing 12 is 14 inches.

2. The length of unit 10B is five inches.

3. The surface area within each expansion chamber of unit 10B, against which steam pressure will be acting will be [(14 inches×3.1416)/4−1]×5 inches=49.978 square inches.

The volume of space within each expansion chamber of unit 10B will be [(14 inches×3.1416)/4−1]×5 inches×3/16 inches=9.370875 cubic inches.

As steam expands from expansion chamber 52A of Unit 10A into expansion chamber 56B of Unit 10B through pipe 143 it will then, as rotation continues, occupy a total volume of 6.3186 cubic inches+9.370875 cubic inches=15.6895 cubic inches.

Pressure will then be reduced to (319.875×6.3186)/15.6895=128.6895 psi.

The total pressure forcing rotation of shaft 18 will be 128.8306×(33.692+49.978)=10,780 pounds.

The pressure within expansion chamber 56B only of unit 10B, forcing rotation of shaft 18 will be 128.8306×49.978=6,438,695 pounds.

For Unit 10C, FIGS. 14–17, assume the following:

1. The inside diameter of stationary housing 12 is 16 inches.

2. The length of Unit 10C is six inches.

The surface area within each expansion chamber of Unit 10C against which steam pressure will be acting is [16 inches×3.1416/4−1]×6 inches=69.3984 square inches.

The volume of space within each expansion chamber of Unit 10C is [(16 inches×3.1416)/4−1]6 inches×3/16 inches=13.0122 cubic inches.

As steam exhausts from expansion chamber 54B of Unit 10B through pipe 147 into expansion chamber 56 of unit 10C, it will, as rotation continues, occupy a total volume of 9.370875 cubic inches+13.0122 cubic inches=22.3831 cubic inches.

Pressure will be reduced to (128.8306×9.370875)/22.381=53.9362 psi.

The total pressure within expansion chamber 54B of Unit 10B and within expansion chamber 58C of Unit 10C, forcing the rotation of power transfer shaft 8 will be 53.9632×(49.978+69.3984)=6,438.9 pounds.

The total pressure within expansion chamber 58C only forcing rotation is 53.936×69.3984=3,743.07 pounds.

For Unit 10D, assume the following:

1. The inside diameter of stationary housing 12 is 20 inches; and

2. The length of unit 10D is 10 inches.

The surface area within each expansion chamber of Unit 10D will be [(20 inches×3.1416)/4−1]×10 inches=140.08 square inches.

The volume of space within each expansion chamber of unit 10D will be [(20 inches×3.1416)/4−1]×10 inches×3/16 inches=27.5775 cubic inches.

As steam expands from chamber 56C of unit 10C, through pipe 152 into expansion chamber 52D of Unit 10D, it will then occupy, as rotation continues, a total volume of 13.0122 cubic inches+27.5775 cubic inches=40.5897 cubic inches.

The pressure will be reduced to (53.936×13.0122)/40.5887=17.2907 psi.

The pressure within expansion chamber 52D only of Unit 10D forcing rotation of shaft 18 will be 17,2907×140.08=2422.08 pounds.

The steam pressure within expansion chamber 58D of Unit 10D just prior to exhausting into condenser 140 will be 17.29 psi. Immediately upon exhausting it will drop to the pressure within condenser 140.

Figure 19:
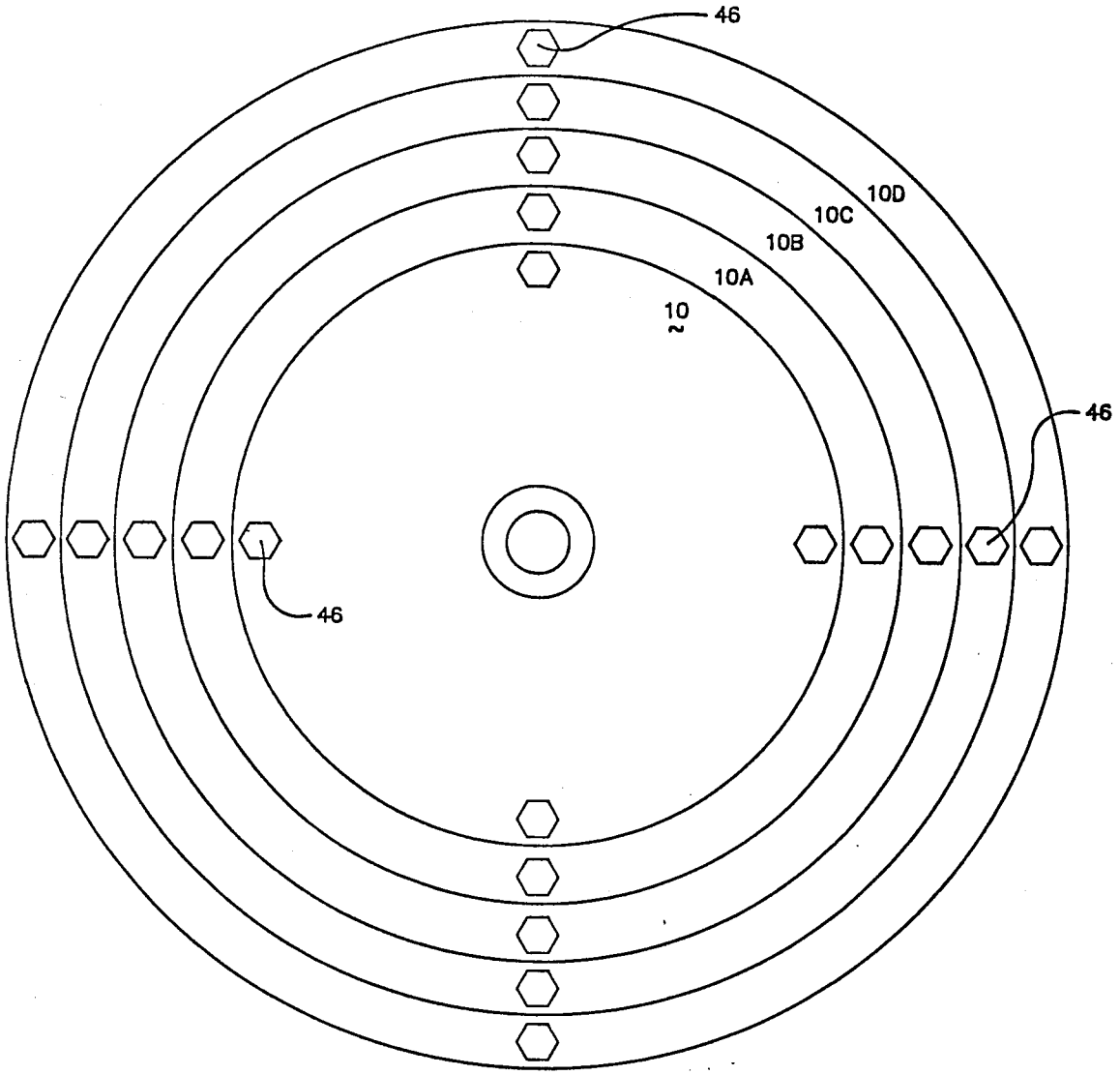
FIG. 19 is a front plan view taken substantially along line 19—19 of FIG. 18.

Referring now to FIGS. 19 and 20, it can be seen that units 10 and 10A–10D can be mounted adjacent each other along and connected to the common output shaft 18. In this manner, the units can be stacked and rigidly secured together such that the power released within each unit contributes to the rotation of output shaft 18. As is illustrated in FIG. 18, each unit must be separated from the other by a divider plate 142. As can be further seen, a divider plate 141 is preferably positioned on top of end plate 42 of the adjacent unit, and both are held in place to housing 12 by bolts 46. Each divider plate 141 will carry a radial push rod assembly of the type described with respect to FIG. 7 in order to operate the exhaust system.

In setting the timing of the operation of the various units 10 and 10A, 10B, 10C and 10D, the beginning of any exhaust period can be delayed by shortening the leading edge of cam surface 102 and terminated earlier by shortening the following edge of cam surface 102 or both.

It should be noted in the stacked engine arrangement that complete exhaust is not possible, and that a counteracting pressure will be carried over within each expansion chamber after each exhaust period is completed. For example, consider Unit 10 with an initial pressure of 1000 psi acting within its expansion chambers and the reduced pressure, after exhausting into expansion chambers of unit 10B, of 319.878 psi. The actual effective pressure within expansion chamber 52 of unit 10 will be 1000−319.878=680.122 psi. However, when any expansion chamber, within which is the counter acting pressure, reaches the position where it is ready to deliver power, the counteracting pressure becomes a pressure acting to force rotation.

Steam table determinations of pressure versus temperature are based on having sixteen ounces of water confined within a space of 1728 cubic inches. Therefore, the maximum weight of water that must ever be allowed within any expansion chamber of engine 10 will be a function of the maximum volume of space within that expansion chamber, in the case discussed 2.9716 cubic inches so that the maximum initial injection of water will weigh 2.9716×(16/1728)=0.0275148 ounces.

In this case, the weight of the "carry over" water within each expansion chamber of engine 10 is determined by the equation 1000/319.978=0.0275148/x, so that x=0.00801279 ounces.

It will be understood that, after only one revolution, the operating pressure within expansion chambers of engine 10 would be 319.878 psi unless additional water is added to each expansion chamber as that expansion chamber is in position to furnish major power and that unless additional water is injected, pressure will be further reduced as rotation continues until no pressure exists and the engine stops.

To keep the engine delivering maximum power, the pressure within each of engine 10 expansion chambers must be maintained at 1000 psi. To do this will require adding 0.0275148−0.0081279=0.01938 ounces of water to each expansion chamber of unit 10 for each revolution.

If less than full power is required, a smaller amount of water can be added. This will be a never ending variable that will, for completely satisfactory operation require pressure or computerized control of injected water.

The pressure within the expansion chambers of each engine will always be different from that within the expansion chambers of adjacent engine units in the arrangement illustrated in FIGS. 14–19. To prevent passage of steam from one unit to another around common power transfer shaft 18, and to prevent escape of steam into the atmosphere around the shaft 18 at the outer end of unit 10 and, in this case, around shaft 18 at the outer ends of unit 10D, an art known seal (not illustrated) of the sort that prevents the escape of fluid around the shaft of belt driven refrigeration compressors is preferably provided at the center of each divider plate 142 and at the center of each end plate 46. In addition, for maximum possible efficiency, this engine must be covered completely with proper insulation.

As can be seen from the above, the present invention provides a unique rolling cylinder engine having only one rolling component which delivers power at high efficiency. This engine becomes completely pollution free if the heat required to heat unit 10 is produced by the combustion of hydrogen and pure oxygen, not oxygen taken from the air which could cause the formation of polluting nitrous oxides. When several of the steam rolling units of the present invention are stacked together as an integral engine, a closed system can be provided whereby exhaust from the steam portions is contained internally, and the only exhaust is that of the fuel necessary to heat the first unit in the stacked unit arrangement. Due to the arrangement of the present invention, with a minimum number of moving portions, maintenance is substantially reduced, thereby adding to the cost efficiency of the invention.

The embodiments of the invention for which an exclusive privilege and properly right is claimed are defined as follows:

1. An engine for rotating an output shaft having a longitudinal central axis, said engine comprising:

a housing defining a cylindrical opening having an inner cylindrical surface and a longitudinal central axis within said cylindrical opening, which said axis is coaxial with the longitudinal central axis of the output shaft;

roller means disposed within said housing, said roller means defining an inner opening having an inner cylindrical bearing surface, an axial length and a longitudinal central axis, said longitudinal central axis of said roller means being substantially parallel with, but radially offset from said longitudinal central axis of said housing and of the coaxial output shaft, said roller means also having an outer cylindrical surface having a diameter less than the diameter of said inner cylindrical opening of said housing so that said roller means is substantially spaced from said inner cylindrical surface of said housing, but for a line of tangential contact therebetween;

means for defining a plurality of two or more chambers between said housing and said roller means;

means for selectively introducing expandable fluid into each of said chambers in rotationally sequential order;

means for expanding said expandable fluid after it has been introduced into a chamber to thereby cause said outer cylindrical surface of said roller means to be urged away from said inner cylindrical surface of said housing at the chamber of fluid introduction and expansion, thereby causing a portion of said roller means to substantially tangentially sequentially roll along said inner cylindrical surface of said housing means so that said longitudinal central axis of said roller means rolls about and substantially parallel with said longitudinal central axis of said housing and also of the longitudinal central axis of the output shaft;

means for exhausting expanded fluid from said chambers in rotationally sequential fashion;

means for rotating the output shaft in response to the rolling movement of said roller means about said inner cylindrical surface of said housing means; and means for substantially preventing slippage between said inner surface of said housing and said outer surface of said roller means.

2. The engine as claimed in claim 1, wherein said roller means comprises a substantially tubular member.

3. The engine as claimed in claim 2, wherein said tubular roller member is sized and positioned within said housing to provide a substantially tangential line of contact between said outer surface of said tubular roller member and said inner cylindrical surface of said housing, said line of contact continuously rolling about said inner cylindrical surface of said housing in response to the rolling movement of said roller means within said housing.

4. The engine as claimed in claim 1, wherein said means for preventing relative slippage between said inner surface of said housing and said outer surface of said roller means comprises a plurality of two or more cogs projecting substantially radially outwardly from said surface of said roller means, and a plurality of two or more wells defined within said inner surface of said housing and located to receive said cogs, said cogs being located to project into said wells and adapted for substantially unrestricted longitudinal movement within said wells in response to the rolling movement of said outer cylindrical surface of said roller means around said inner cylindrical surface of said housing.

5. The engine as claimed in claim 4, wherein each said cog is of such a length that a portion of at least two said cogs is substantially always partially engaged within two such receiving wells to prevent relative slippage between said inner surface of said housing and said outer surface of said roller means.

6. The engine as claimed in claim 1, wherein said chamber defining means comprise a plurality of two or more substantially longitudinal barrier members circumferentially spaced about and projecting substantially radially inwardly from said inner cylindrical surface of said housing, said barrier members being biased against said outer cylindrical surface of said roller means and extending substantially the entire axial length of said roller means, each said chamber being defined by each sequentially neighboring pair of barrier members, the portion of said inner surface of said cylindrical housing between each said pair of neighboring barrier members and the portion of said outer cylindrical surface of said roller means between each said pair of neighboring barrier members.

7. The engine as claimed in claim 6, wherein said substantially longitudinal barrier members comprise elongated vanes, and said housing defines a plurality of two or more substantially longitudinal elongated channels defined in said inner cylindrical body thereof, each said elongated channel being sized, shaped and located to snugly receive one such elongated vane therein.

8. The engine as claimed in claim 7, wherein bias means are disposed in each said channel, to thereby bias each said vane against said roller means to thereby maintain firm, fluid-tight contact of each said vane against said cylindrical outer surface of said roller means, said bias means being adapted to permit each said elongated vane to be sequentially compressed into one such receiving channel as said outer cylindrical surface of said roller means rolls about said inner cylindrical surface of said housing in response to the sequential introduction into and expansion of expansive fluid in said chambers.

9. The engine as claimed in claim 1, wherein said fluid exhaust means comprises a plurality of exhaust ports extending through said housing, each said chamber having at least one said exhaust port associated with it, each said chamber port adapted for venting expanded fluid from said chamber with which it is associated to said exterior of said housing means, and exhaust control means associated with each said chamber for selectively controlling the access of expanded fluid to said one or more exhaust port associated with said chamber.

10. The engine as claimed in claim 9, wherein each said exhaust control means comprises a channel disposed in and defined by said inner cylindrical surface of said housing and extending longitudinally for a distance substantially equivalent to said axial length of said housing means, an elongated bar member disposed in each said channel, and bias means for normally biasing said bar member against the outer cylindrical surface of said roller means to thereby prevent access of fluid in said chamber to said exhaust port.

11. The engine as claimed in claim 10, wherein each said exhaust port is disposed between one said chamber defining means and one said exhaust control means.

12. The engine as claimed in claim 10, wherein said exhaust control means further comprises means for selectively compressing each said bar member into each said channel to permit fluid to pass from said chamber to said exhaust port.

13. The engine as claimed in claim 12, wherein said bar member compression means comprises a cam member disposed on the output shaft for rotation therewith, and a plurality of push rod means positioned between said cam member and said bar members are adapted for selective movement radially outward in response to said cam member, said push rod means selectively pressing said bar members into said channels in response to rotation of said cam member to thereby permit the exhausting of fluids from said chambers.

14. The engine as claimed in claim 13, wherein each said push rod means comprises a pair of elongated push rod members aligned end to end, said first member of said pair projecting through said roller means and radially extending from the outer surface of said roller means to the inner surface of said roller means, and the second member of said pair extending between said first push rod member and said cam member, the juncture of said first and second push rod members of each said pair of push rod members permitting slight pivotal movement therebetween to accommodate rolling movement of said roller means.

15. The engine as claimed in claim 1, wherein said output shaft rotating means comprises a power transfer arm connected to said shaft for rotation therewith and extending radially outwardly from said shaft toward said inner cylindrical surface of said roller means, and a roller member secured at one distal end of said power transfer arm and adapted for contact with said inner cylindrical bearing surface of said roller means, said roller member firmly engaging said inner surface of said roller means and adapted for rolling movement therealong in response to rolling movement of said roller means within said housing means to thereby rotate said output shaft in response to the movement of said power transfer arm along said inner cylindrical surface of said roller means.

16. The engine as claimed in claim 15, wherein said output shaft rotating means further includes an extension of said power transfer arm which extension includes a counter-balance weight disposed substantially at said second distal end thereof diametrically opposite said roller member to balance the oscillating movement of said rolling cylinder means.

17. Said engine as claimed in claim 1, wherein the expandable fluid introduced into said chambers comprises a liquid which is convertible to an expanding gas, and wherein said engine further includes means for expanding said liquid is a heating means associated with said housing.

18. The engine as claimed in claim 17, wherein said fluid introduction means comprises means for inserting liquid into said chambers, whereby said heating means can convert said liquid to a vaporized state and expand the resulting vapor within said chambers.

19. The engine as claimed in claim 18, wherein said liquid comprises water and said vapor comprises steam, and said heating means has the ability of heat said chambers to any desired temperatures within the range of about 200° to about 700° F.

20. In a rolling cylinder engine for transmitting power to an output shaft by rotating the same along the axis of said shaft, said engine including:

a housing having an interior surface defining a cavity, rolling means disposed within said housing cavity and having a central axis, a plurality of expandable chambers defined within said housing; means for introducing fluid into and means for exhausting expanded fluid from said chambers to move said rolling means and rotate said output shaft; wherein the improvement comprises said rolling means being a member having an inner cylindrical bearing surface and an outer cylindrical surface spaced radially inwardly of said housing interior surface, the central longitudinal axis of said rolling member being constantly changing, but substantially parallel with and radially offset from the axis of said output shaft.

21. The improvement of claim 20, wherein said rolling means further includes means to prevent relative rotational movement between said housing and said tubular rolling member to enable said rolling member to roll against said interior surface of said housing and to revolve around the ever changing central axis of said rolling member about the axis of said shaft.

22. The improvement of claim 20, wherein said expandable chambers are defined by a plurality of barrier members circumferentially spaced about and projecting from said interior surface of said housing to engage said outer surface of said rolling member, said barrier member being biased against said outer surface of said rolling member and extending the entire axial length of said rolling member to form substantially gastight chambers between each pair neighboring pair of barrier members.

23. The improvement of claim 22, wherein said barrier members comprise elongated vanes, and said housing includes a plurality of channels disposed in said interior surface thereof, said channels being sized and shaped to snugly receive said vanes therein, and wherein said improvement further includes spring bias means disposed within said channels to bias said vanes against said outer cylindrical surface of said rolling member to maintain firm, substantially gastight contact against said surface of said rolling member while permitting movement of said vanes into said channels as said rolling member rolls about said interior surface of said housing.

24. The improvement of claim 22, wherein said means for introducing fluid into said chambers comprise fluid injection means, and wherein further means for expanding fluid within said chamber are provided to expand said chamber and urge said surface of said rolling member away from said interior surface area of said housing incompassed within said chamber.

25. The improvement of claim 24, wherein said means for expanding fluid within each said chamber includes heating means associated with said housing to raise the temperature of said housing sufficiently to expand fluid as it enters said chamber.

26. The improvement of claim 25, wherein said fluid is a liquid, said expanded fluid is a gas, and said heating means is adapted to convert said liquid to an expanded gas as said liquid is injected into said chamber.

27. The improvement of claim 22, wherein said means for exhausting gas from said chambers comprise a plurality of exhaust ports disposed in said housing with each said exhaust port adapted for venting expanded fluid from one said chamber to the exterior of said housing, and exhaust control means are disposed in each said chamber for selectively controlling access of expanded fluid to said exhaust port.

28. The improvement of claim 27, wherein each said exhaust control means comprises a channel extending substantially the axial length of said housing, an elongated bar member is disposed in each such channel, and bias means are located within each channel to urge said bar member against said outer surface of said rolling member to substantially prevent access of expanded fluid in said chamber to said exhaust port, each exhaust port being disposed between a chamber barrier member and an exhaust control bar.

29. The improvement of claim 28, wherein said exhaust control means further comprises means for selectively compressing said bar members into said channels to permit passing of expanded fluid from said chamber to said exhaust port.

30. The improvement of claim 20, wherein said rolling means further includes shaft rotating means comprising a power transfer arm connected to said output shaft for rotation therewith, and roller bearing means connected to one end of said power transfer arm and adapted for continuous rolling engagement with said inner cylindrical bearing surface of said rolling member, said power transfer arm being rotated in response to the rolling motion of said rolling member within said housing to thereby rotate said power output shaft.

31. The improvement of claim 30, wherein said power transfer arm further includes a counter-balance weight disposed at said distal end thereof opposite said roller bearing means.

32. The improvement of claim 20, wherein a plurality of said rolling cylinder engines are mounted to a common power output shaft.

33. The improvement of claim 25, wherein a plurality of two or more rolling cylinder engines are mounted to a common power output shaft, and wherein only said first of said plurality of engines includes said heating means, the remaining engines receiving said expanded fluid in the form of exhaust gas originating from said preceding adjacent rolling cylinder engine.

34. The improvement of claim 33, wherein the exhaust from the last said engine of the plurality of engines is condensed, and the resultant liquid is redirected to said first said engine injectors, thereby forming a closed liquid and gas system for the operation of said plurality of rolling cylinder engines.

* * * * *